United States Patent [19]

Slysh et al.

[11] 4,116,258

[45] Sep. 26, 1978

[54] PANEL DEPLOYMENT AND RETRACTION SYSTEM

[75] Inventors: Paul Slysh; LeRoy E. Siden, both of San Diego, Calif.

[73] Assignee: General Dynamics Corporation, San Diego, Calif.

[21] Appl. No.: 870,305

[22] Filed: Jan. 18, 1978

[51] Int. Cl.[2] ..... E06B 3/32

[52] U.S. Cl. ..... 160/213; 244/173

[58] Field of Search ..... 160/130, 188, 213; 244/173

[56] References Cited

U.S. PATENT DOCUMENTS

| | | | |
|---|---|---|---|
| 3,477,662 | 11/1969 | Anderson | 244/173 |
| 3,532,299 | 10/1970 | Williamson et al. | 244/173 |
| 3,627,585 | 12/1971 | Dollery et al. | 244/173 |
| 3,677,508 | 7/1972 | Dillard et al. | 244/173 |
| 4,015,653 | 4/1977 | Slysh et al. | 160/213 |

*Primary Examiner*—Peter M. Caun

*Attorney, Agent, or Firm*—John R. Duncan

[57] ABSTRACT

A mechanism for deploying and retracting an isogrid structure particularly suited for use in supporting low weight reflective or absorbtive surfaces, characterized by a plurality of hinged isogrid panels stowed in an accordian folded stack arranged for deployment into a long continuous strip or array. Two deployment frames in contact with the stack of panels are rotated to a position perpendicular to the stack. Attached at the outermost ends of each panel hinge are panel rollers. In the accordian folded position, these rollers are alternately located near the top and bottom of the folded stack. The deployment frames each contain an arced raceway for engagement of the upper panel rollers and a straight raceway for engagement of the lower rollers. An upper roller travels down the arced raceway thereby progressively unfolding a pair of hinged panels until they are flat and lie in the deployment plane where they are subsequently extended into the deployed position. For retraction the panels are driven back toward the stack where the upper rollers travel up the arced raceway causing a hinged pair of panels to be refolded together and thereafter be moved into the stack stowage container.

9 Claims, 29 Drawing Figures

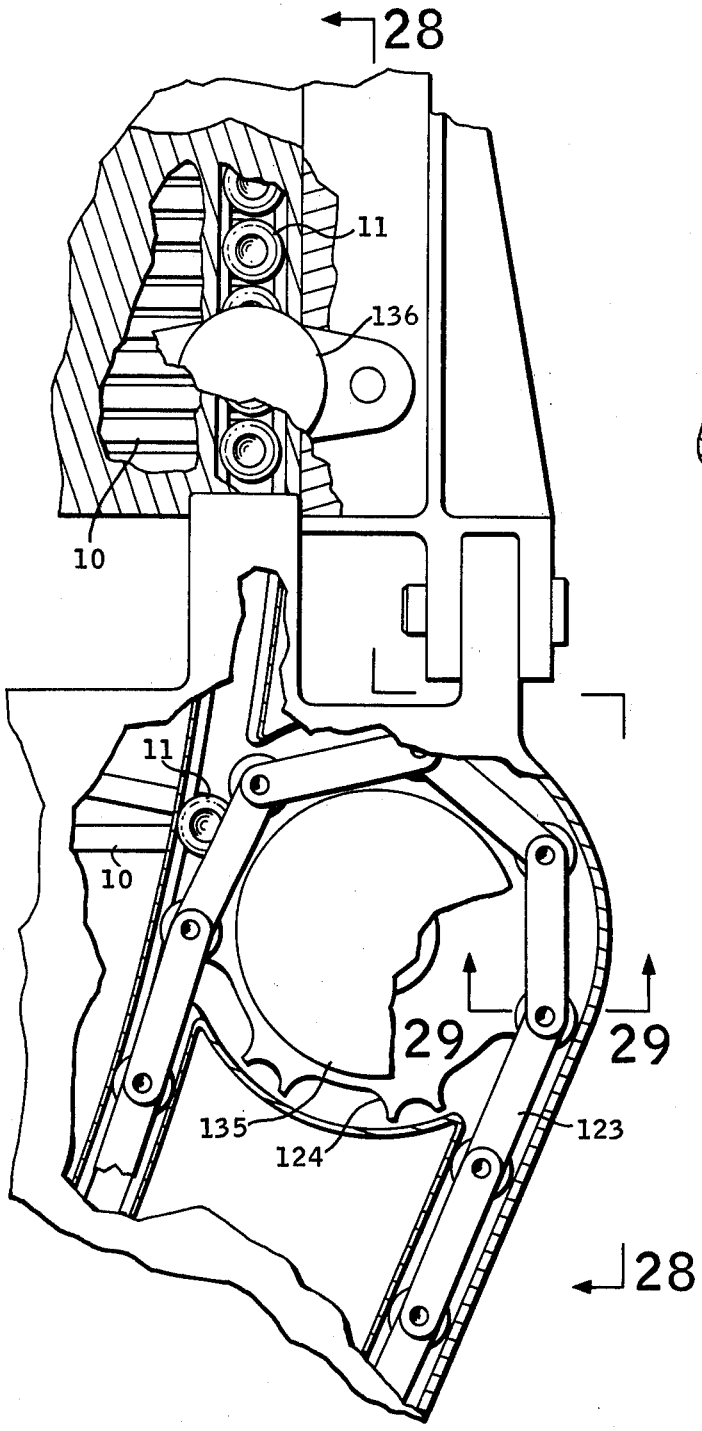
FIG. 27
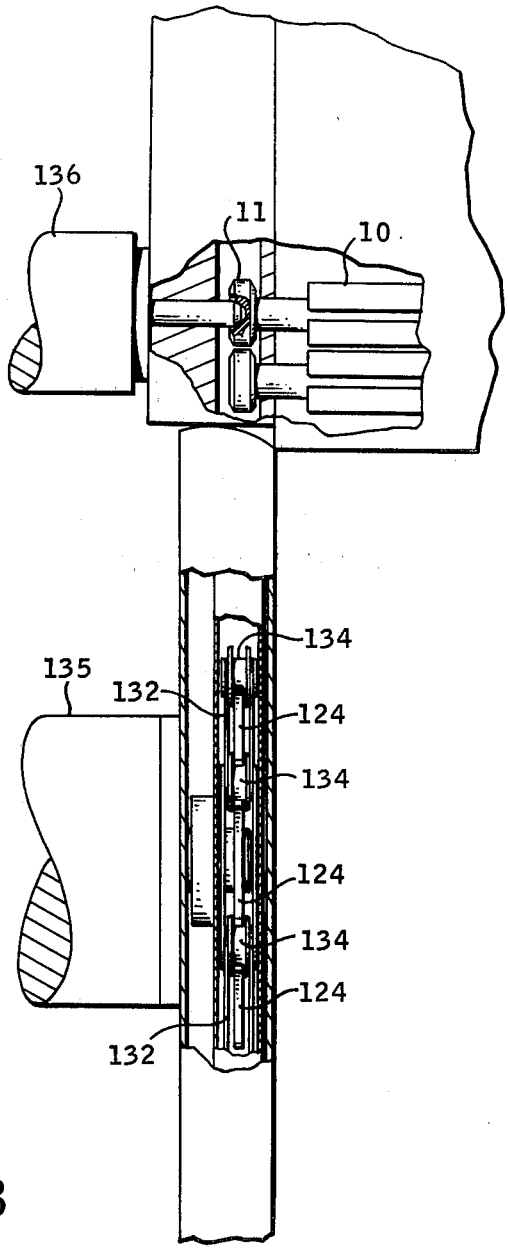
FIG. 28
FIG. 29
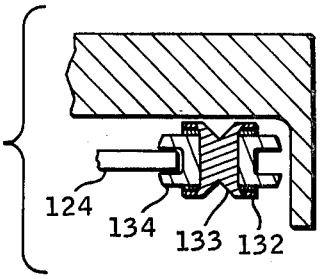

PANEL DEPLOYMENT AND RETRACTION SYSTEM

BACKGROUND OF THE INVENTION

A wide variety of mechanisms have been utilized to deploy panels from a storage container into some desired geometric patterned panel or array. Typically such systems are used to deploy radio or radar antennas, solarcell panel arrays for space craft, solar reflectors, etc. Some existing mechanisms for example utilize telescoping booms of circular or rectangular cross-section which support a flexible panel stored on a drum, and as the drum unwinds the panel is deployed between the two telescoping booms in a windowshade manner.

Another mechanism utilizes telescoping booms and stores the panel in an accordian folded pack, deploying the panel between the booms in a similar manner to accordian pleated household drapes being drawn across a window. Other systems use inflatable booms or structures to support an array. In another, accordian folded panels are deployed by applying torque to each of the many panel hinges by means of a run-around cable and pulley system having drums located at each hinge point. In such arrangements the panels are only coplanar upon full deployment, and should the system jamb during deployment the panels would be in a zig-zag patterned array. An exception is the earlier described drum deployment system which would have a portion of the window shade array deployed coplanar and useable should the deployment not be totally completed.

Many mechanism and apparatuses for actuating these systems utilize complex and heavy scissor arms, while others use springs for powering the deployment. Springs are heavy for the amount of power they supply, and additionally they do not provide the capability of retracting and restowing the array. In order to control the rate of deployment, dash pots are used in conjunction with the springs on some systems, thus reducing even more the power efficiency of the springs.

At least one of the inflatable structures utilizes a thermal setting resin to reinforce the structure and give it a permanent set once it has been deployed, and in still another refinement there is a metallizing of the inflatable structure after deployment. Clearly such systems are not capable of retraction and restowing.

A device having a deployment and retraction system overcoming the previously described limitations was disclosed in our U.S. Pat. No. 4,015,653, issued Apr. 5, 1977. Disclosed in said patent was a deployable structure having a foldable panel strip comprised of a plurality of rectangular panels hinged edge-to-edge in such a way that the panels could be folded in accordian fashion to provide a flat stack of minimum stowage volume. The invention utilized panels that optimized the cantilever and torsional mass stiffness properties of the system by employing lighter first-deployed panels than the last-deployed panels, eliminated reliance on spring energy and force balances, and employed a fully positive, fully engaged deployment mechanism.

The deployment mechanism utilized two deployment arms, each arm hinged at one end to the stowage compartment and having a second hinge partway along it's length to permit folding it into a stowable length. A crawler, fitted around the outside diameter of each deployment arm in a telescoping manner, moved along the full length of the deployment arm by means of motor driven pinions engaging a rack on the deployment arm. The crawler carried the first panel with it as the crawler traversed the length of the deployment arm. Subsequent deployment of panels was accomplished by a second set of motor driven sprockets mounted on the crawler and engaged in perforations along the edges of each panel, the deployed strip comprised of a plurality of panels advancing much like a film strip in a movie projector.

To retract the deployed strip a creaser bar extending across the bottom of the strip in a lateral direction under the hinge line of two adjoining panels was raised to jackknife this pair of panels sufficiently to permit the panel edge engaged sprockets to drive the next pair of panels toward the creaser bar, and in so doing cause the jackknifed pair of panels to fold compactly together in a back-to-back position in front of the stowage container. A shutter was utilized to capture each pair of folded panels and move them into the container.

Subsequently in our U.S. application Ser. No. 863,036 filed Dec. 21, 1977 there was disclosed an improvement in the deployment mechanism of our earlier invention, U.S. Pat. No. 4,015,653, issued Apr. 5, 1977. The deployment system therein disclosed comprised fewer elements, a reduction in size of some elements, and reduction in the number of mechanical movements to obtain a lighter weight system having increased reliability. The deployment arm crawlers, crawler drive motors & sprockets, and deployment arm racks were eliminated. Additionally, the deployment arms were reduced approximately one third in length. This was accomplished by attaching a thin deployment tape to the first panel and engaging this tape in the panel deployment drive to remove the first pair of panels from the stowage container.

SUMMARY OF THE INVENTION

The present invention is an improvement in the deployment mechanism of our earlier inventions disclosed in U.S. Pat. No. 4,015,653, issued Apr. 5, 1977 and application Ser. No. 863,036, filed Dec. 21, 1977.

The improved deployment and retraction system is utilized on a deployable structure having a foldable panel strip comprised of a plurality of rectangular panels hinged edge-to-edge in such a way that the panels may be folded in accordian fashion to provide a flat stack of minimum stowage volume. Each panel is biased to assume curvature in a plane lateral to the deployment direction to stiffen the deployed strip, as does the curvature in a carpenter's steel measuring tape. In the stowed position each panel is forced into a substantially flat contour, the spring action of each panel helping to restrain movement of the panel stack in the stowage container during transportation and assisting in removal of the panels from the container during the deployment mode.

In the present invention the use of drive sprockets engaging perforated slots along the panel edges has been eliminated, thereby reducing the panel edge fixity requirements. Panels are connected to the deployment structure only at each hinge end by means of rollers, the rotational axes of said rollers coinciding with the panel-to-panel hinge axes. Since the panel edges do not contact the deployment structure there is no danger of scuffing any surface attached to the panels, such as a reflective sheet or a solar array blanket or electrical harnesses as examples.

Deployment of the stowed panels is initiated by approximately 90° rotation of the deployment frames. The deployment frames contain two parallel raceways, a curved upper raceway engages the outer guide rollers on the top side of the panels and a straight inner raceway engages the inner guide rollers on the lower side of the panels. The curved raceway acts to crease the panels along the hinge line when the panels are being retracted, thus eliminating the need for the previously required creaser arms. Additionally, no shutter arms are required. Also, because there is no panel edge fixity the curved raceway permits gradual assumption of panel curvature as the panels are deployed.

All retraction and deployment control mechanism are located outboard of the panels in the deployment frames, and by eliminating panel edge engagement, creaser arms, and shutter arms any surface materials mounted on the panels are not touched by the mechanism, and the danger of scuffing a delicate panel surface has been eliminated.

The above described improved features and others will hereinafter be described in more detail so that a clearer understanding of the new and improved deployment system may be realized.

BRIEF DESCRIPTION OF THE DRAWINGS

The advantages of the present invention, which will subsequently become apparent, reside in the construction and operation as hereinafter described, reference being made to the accompanying drawings showing the preferred embodiment of the invention, wherein:

FIG. 27 is a partial view of the upper portion of the deployment frame and chain drive as shown by circle line 27 in FIG. 23.

FIG. 28 is a plan view of the upper raceway taken substantially from a plane indicated by line 28—28 in FIG. 27.

FIG. 29 is a cross-section view of the power chain taken thru a chain roller as indicated by section line 29—29 in FIG. 27.

DETAILED DESCRIPTION OF THE INVENTION

Figures 1, 2, 3, 4, 5, 6, 7, 8, 9, 10:
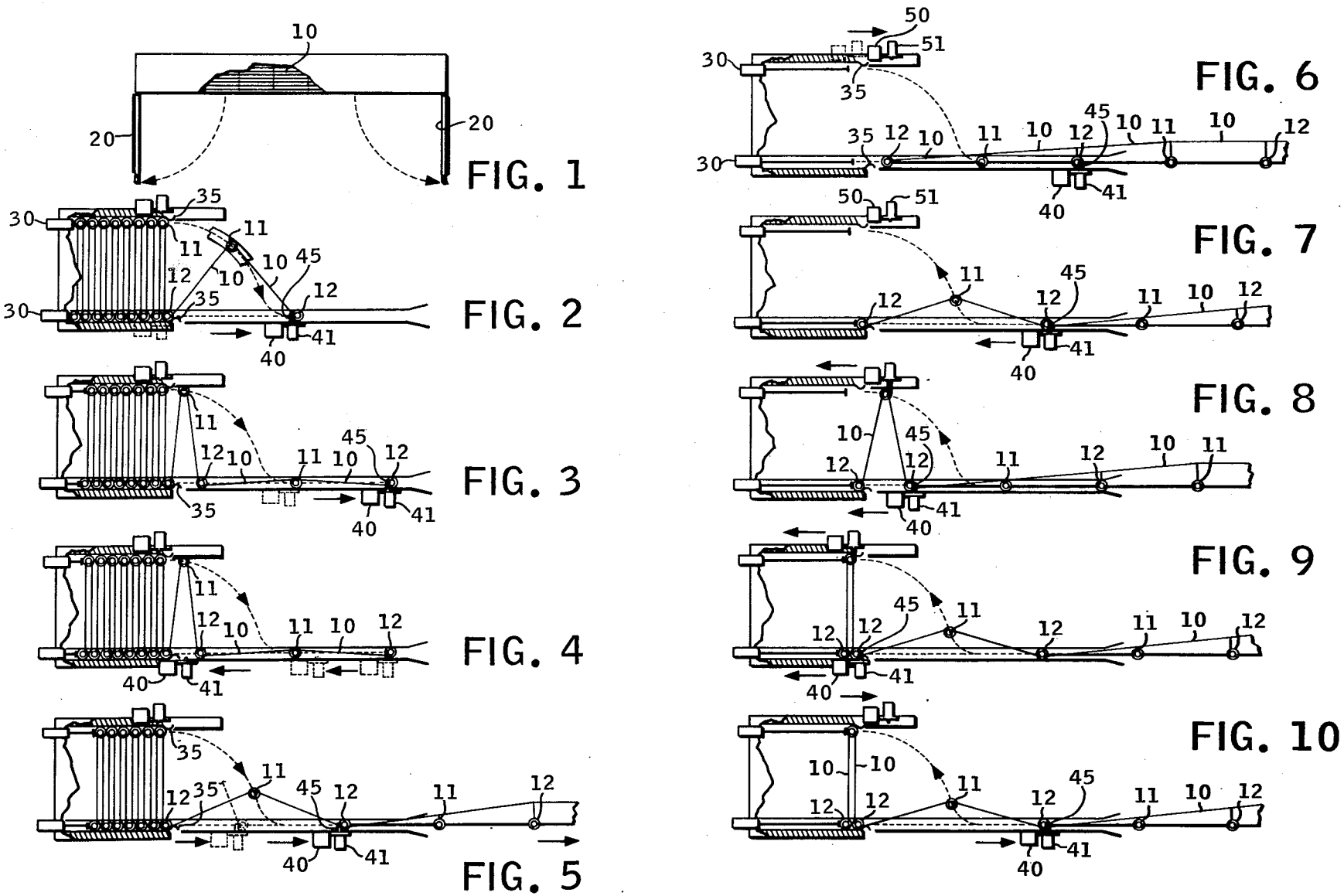
FIGS. 1 thru 5 are schematic presentations of the sequential steps of deploying the panels.
FIGS. 6 thru 10 are schematic presentations of the sequential steps of retracting the panels.

Referring now to the drawings in detail, FIG. 1 illustrates schematically a plan view of the system wherein a plurality of panels 10 are folded in accordian fashion and stowed in a container. Two deployment frames 20 stowed against the front end of the panel stack are rotated approximately 90° to start the deployment sequence.

FIG. 2 illustrates schematically a side elevation view of one of the deployment frames 20 and a plurality of accordian folded panels 10. At the end of each upper panel hinge is located an upper roller 11 and at each lower panel hinge is located a lower roller 12. The upper rollers 11 engage a curved raceway in the deployment frame 20, and the lower rollers 12 engage a straight raceway along the bottom of deployment frame 20. A deployment carriage 40 is adapted to travel back and forth on the deployment frame 20. A plunger solenoid 41 is mounted on the deployment carriage 40 in such a manner that when the solenoid plunger is extended it will contact lower roller 12 and when the solenoid plunger is retracted it will clear the lower roller. With plunger solenoid 41 extended and in contact with the first lower roller 12, the deployment carriage 40 moves to the right causing the first pair of stowed panels to unfold.

In FIG. 3 the deployment carriage 40 has reached the limit of its travel to the right, and the first pair of panels are completely unfolded. The second pair of panels have just exited the panel stack and are still substantially in their folded position. At this time the plunger solenoid 41 is energized, the plunger retracts, and the deployment carriage 40 moves to the left.

In FIG. 4 the deployment carriage 40 has fully returned to the left, and the solenoid 41 is retracted. When the solenoid is de-energized and the plunger extends the carriage will again start moving to the right carrying the lower roller 12 of the second pair of panels as shown in FIG. 5. This sequence is repeated again and again until all panels are deployed.

As shown in FIGS. 2 thru 5, hinge guide rollers 11 and 12 are restrained in the stowage container by retaining clip springs 35, which must be overcome to deploy or retract panels. Negator springs 30 push on the hinge guide rollers 11 and 12, moving the folded panel stack forward to hold one set of rollers in contact with the retaining clip springs 35.

In FIG. 6 the entire stack of panels are deployed into a cantilever strip array having a lateral curvature for stiffening the deployed strip. To retract this strip array the carriage 40 is positioned to the right of lower roller 12 of the last deployed pair of panels, and the solenoid 41 is de-energized so the plunger is extended.

In FIG. 7 the carriage 40 has started moving to the left toward the stowage container, and the first lower roller 12 has passed by the retainer clip spring 35. The first upper roller 11 has started up the arc path of the upper raceway in deployment frame 20. This initial curved motion of upper roller 11 rotates the two panels about their common hinge to overcome their coplanar dead-center relationship, "creasing" them so they may be subsequently refolded into a back-to-back relationship for stowage.

In FIG. 8 a retraction carriage 50 carrying retraction solenoid 51 has moved beyond the stowage container sufficiently to be to the right side of the upper roller 11 as the two panels are approaching their fully folded position. Retraction carriage 50 and solenoid 51 are similar to the deployment carriage 40 and solenoid 41 in the manner in which they operate, except that the retraction solenoid plunger 51 extends when energized, whereas the deployment solenoid plunger 41 retracts when energized. At the panel position shown, both the upper carriage 50 and the lower carriage 40 move to the left toward the container to complete the folding sequence.

In FIG. 9 both lower rollers 12 and the upper roller 11 of the first retracted pair of panels have passed by their respective clip springs 35 and the pair of panels are in their fully folded position. Final movement of the lower carriage 40 has drawn the next upper roller 11 of the next pair of panels up into the curved raceway of deployment frame 20.

In FIG. 10 the upper retraction solenoid 51 is deenergized, retracting the plunger, and upper carriage 50 has moved to the right. The lower carriage 40 has also moved to the right and has engaged the lower roller 12 of the second pair of retracting panels. The steps shown in FIGS. 7 thru 9 will be repeated again and again until the complete strip array of hinged panels has been accordian folded and stowed in the container.

Figure 12:
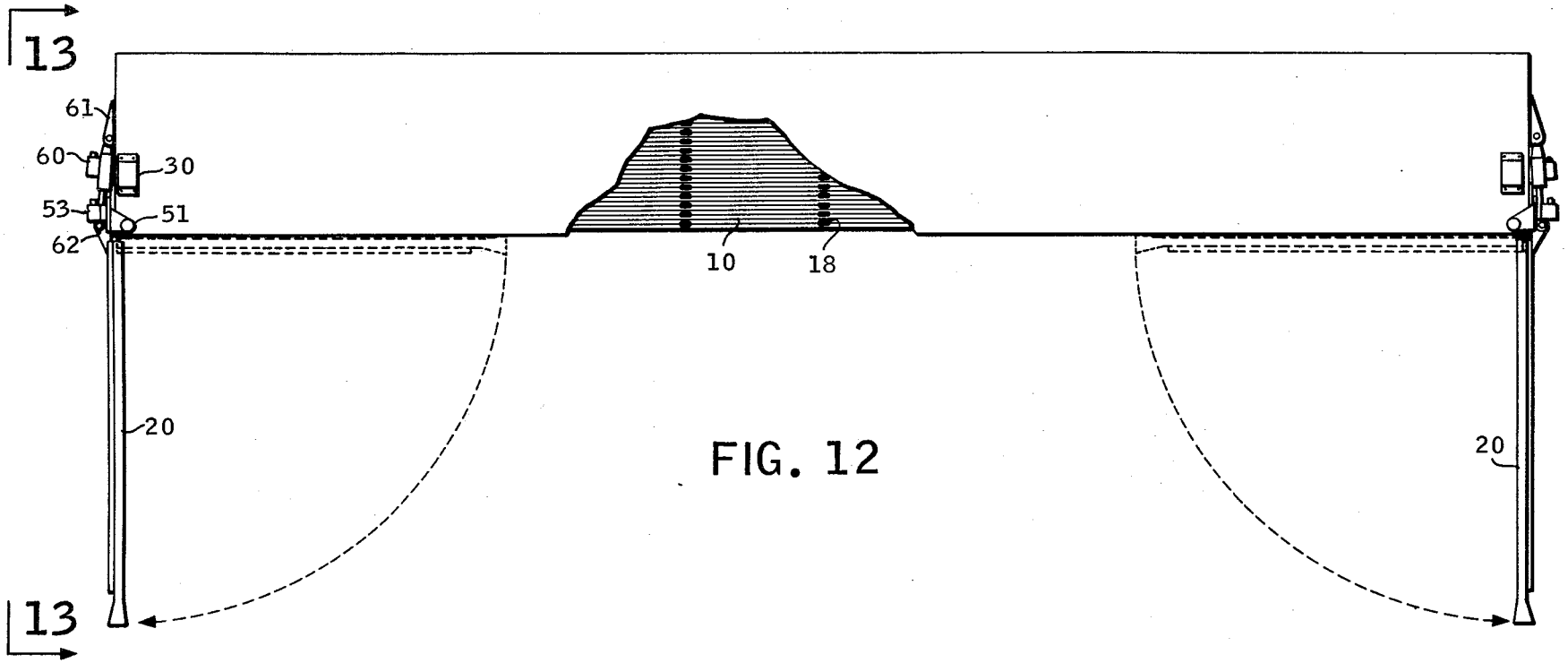
FIG. 12 is a plan view of the general arrangement of the system.
Figure 11:
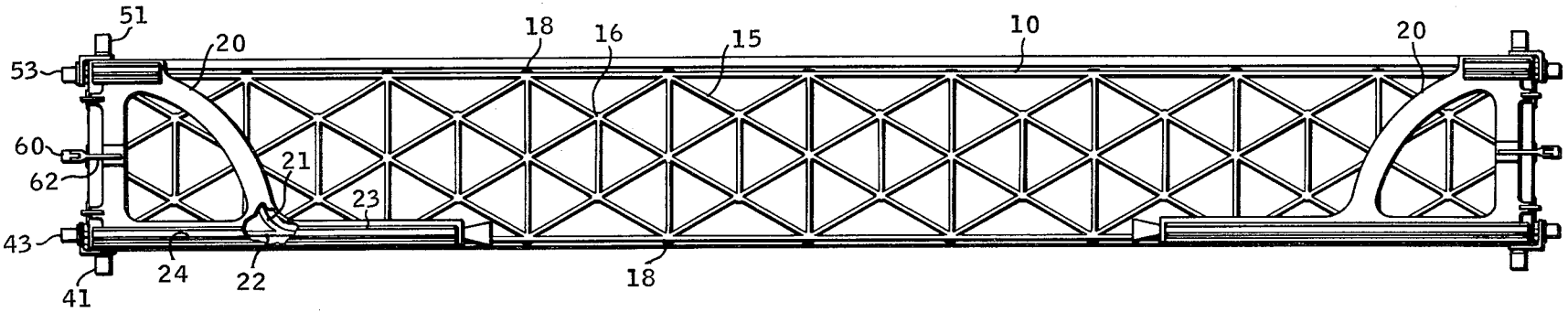
FIG. 11 is a front elevation view of the general arrangement of the system.
Figure 13:
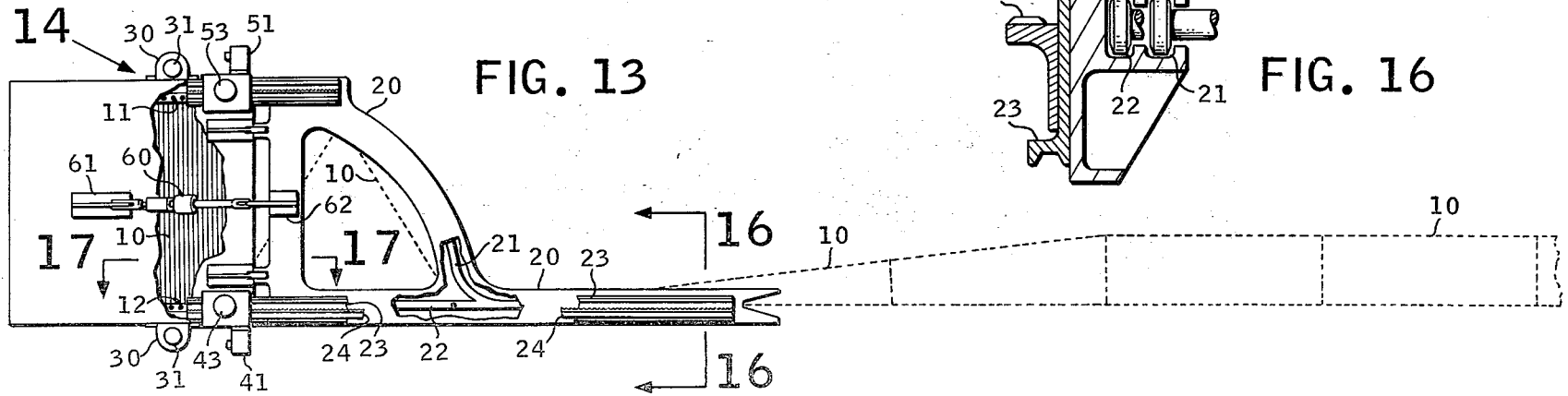
FIG. 13 is a side elevation view of the general arrangement of the system taken substantially from a plane indicated by line 13—13 in FIG. 12.

Referring now to FIGS. 11, 12, and 13 which are front, top, and side views respectively of the general arrangement of the system, it will be seen that each of the deployment frames 20 contain an upper raceway 21 which starts at the top of the frame 20 and arcs downward until reaching the transition area where it curves in an opposite direction to become tangent to a straight portion of the raceway which extends along the lower edge of the frame 20. A secondary raceway 22, which is outboard of the curved raceway 21, is straight and runs along the lower edge of the frame 20, and for approximately half of it's length is parallel to the straight portion of the upper raceway 21. The upper raceway 21 is adapted to engage and capture the upper panel rollers 11, while the lower raceway 22 is utilized to guide the lower panel rollers 12.

In the fully stowed position the deployment frames 20 are folded flat against the accordian folded stack of panels 10. The deployment frames are hinged to the stowage container and are rotated approximately 90° to the deployment position by means of deployment frame actuators 60. These actuators 60 are attached to the stowage container by means of mounting brackets 61 and are connected at the opposite end to their respective deployment frame 20 by means of a horn 62. Any type of linear actuator may be utilized such as for example hydraulic or pneumatic piston and cylinder arrangement. However in the preferred embodiment all controls are electrically powered, and the preferred actuator comprises a linear recirculating ball nut and screw type actuator driven by a d.c. stepping motor. Stepping motors function in a series of small angular displacements in which each displacement or step is caused by application of a d.c. signal. Stepping motors are available in a variety of numbers of steps per revolution as well as speeds of stepping. The circuitry for switching the polarity of the motor stator poles and the memory logic utilized is well known to those skilled in the art and therefore for clarity none of this hardware or the associated electrical harnesses are shown in the drawings.

The individual panels 10 are an extremely light isogrid structure comprised of a plurality of grid members 15 arranged in a pattern of contiguous isosceles triangles and joined at their corners by circular nodes 16, best seen in FIG. 11. This panel structure is adaptable to supporting thin light-reflective or radio frequency reflective materials, solar blankets, or other surface materials. Grid members 15 may have a general cross-section most suitable for the intended use such as T-section, Z-section or channel section. Weight of this open isogrid structure is a function of the thickness of grid members 15 and the node-to-node spacing, and in most instances the structural strengths and stiffnesses compare superior for a given weight to honey-comb sandwich construction usually employed for such uses.

Hinge fittings 18 are located along each of two opposite edges of panels 10 at the intersections of grid members 15 and are adapted to provide at least 180° relative movement between panels. The panels 10 are hinged together by means of these hinge fittings 18 to fold in alternate directions with respect to one another. When fully deployed the panels lie in a common plane and assume a lateral curvature forming a structurally stable configuration similar to the extended carpenter's steel tape. This preformed curvature, giving each panel a leaf-spring characteristic, can only exist in a panel when it has become coplanar with other deployed panels. In the stowed position this uni-directional curvature is fully removed by mutual reaction at hinges 18 between abutting panels. In the stowed position the alternate folding of panels causes the uni-directional curvature preload in each pair of back-to-back panels to mutually cancel out, and the hinge line is a straight line. It is only when this pair of panels rotate into a common plane that the hinge restraint is removed and the panels may assume a mutual curvature. Upon retraction, the curved raceway 21 guides upper rollers 11 upward with sufficient force to overcome the curvature preload in the panels and again cause the hinge line to become straight.

Figure 15:
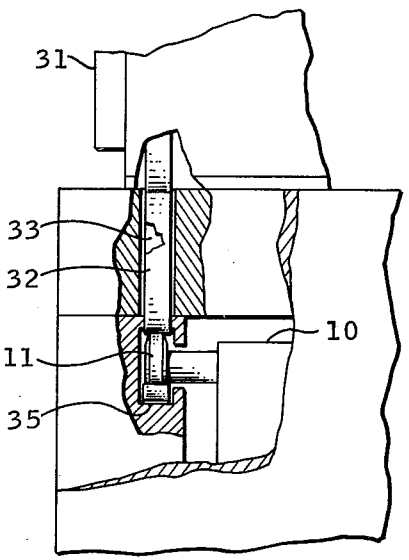
FIG. 15 is a sectional view taken substantially along a plane indicated by section line 15—15 in FIG. 14.
Figure 14:
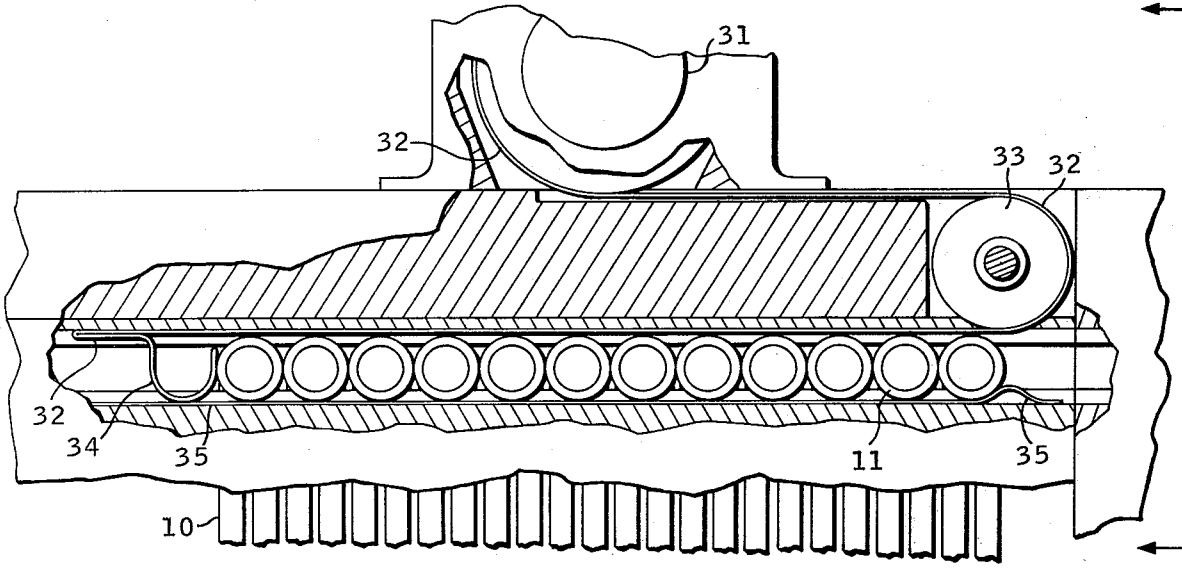
FIG. 14 is an enlarged partial view of the upper portion of the panel stack.

FIGS. 14 and 15 illustrate the construction of the negator spring 30 in more detail. A clock spring driven drum 31 provides a tension to the tape 32, which may be of plastic or metal such as stainless steel. The tape 32 is wrapped around drum 31 and extends over pulley 33 and across the top of the panel stack, terminating at pusher 34. The roller pusher 34 is shaped to engage the last upper roller 11 to bias the plurality of upper rollers 11 toward clip spring 35 and the front of the stowage container. In a like manner a negator spring assembly 30 is located at the bottom of the panel stack to bias the lower panel rollers 12 toward the front of the stowage container.

Figure 16:
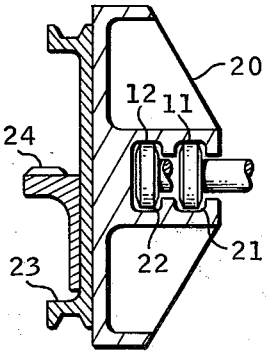
FIG. 16 is a sectional view of the raceways taken substantially along a plane indicated by section line 16—16 in FIG. 13.

FIG. 16 is a cross-section thru the lower portion of deployment frame 20 taken along a plane designated by line 16—16 in FIG. 13. The cross-section of deployment frame 20 is generally T-shaped with the widened upstanding portion of the T containing the two roller raceways. The outer raceway 22 guides the lower rollers 12 and the inboard raceway 21 guides the upper rollers 11. A carriage track 23 runs along the frame 20 and is shaped to guide wheels of the deployment carriage 40 along it's upper and lower channel surfaces. A gear rack 24 is located approximately midway between the upper and lower channel surfaces of carriage track 23.

Figure 17:
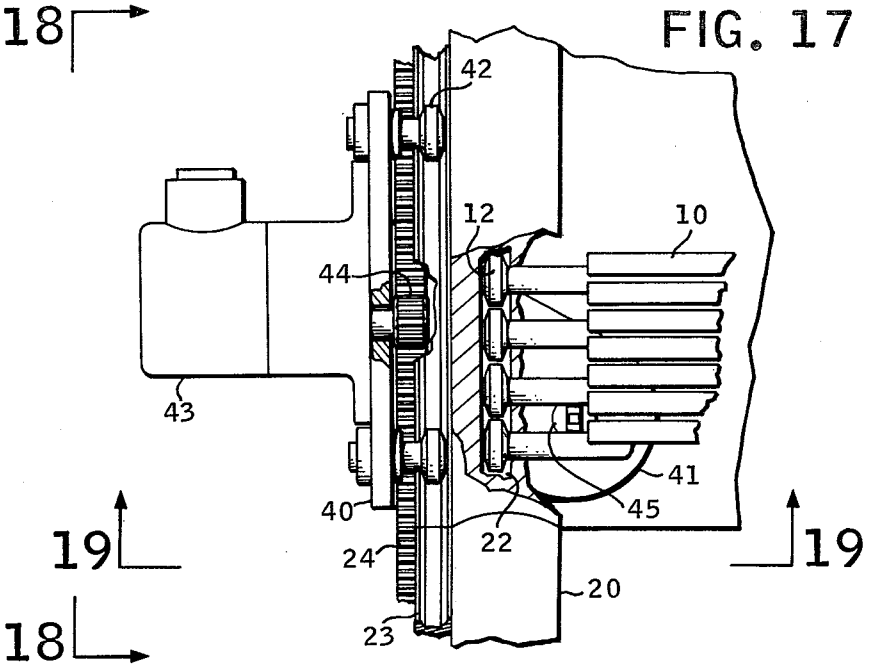
FIG. 17 is a partial plan view of the panel deployment drive taken substantially from a plane indicated by line 17—17 in FIG. 13.
Figure 19:
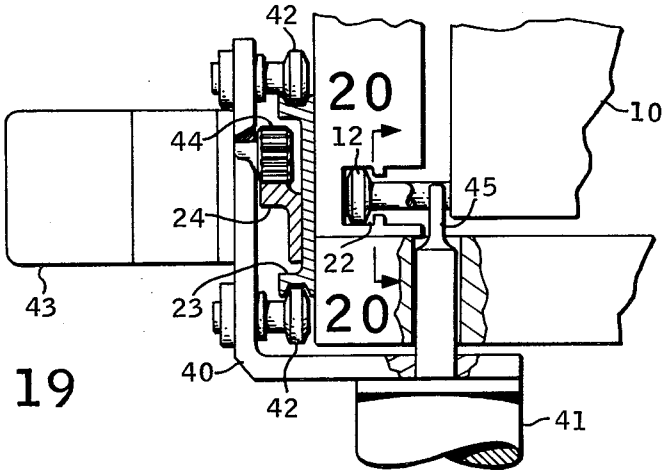
FIG. 19 is a sectional view taken substantially along a plane indicated by section line 19—19 in FIG. 17.
Figure 18:
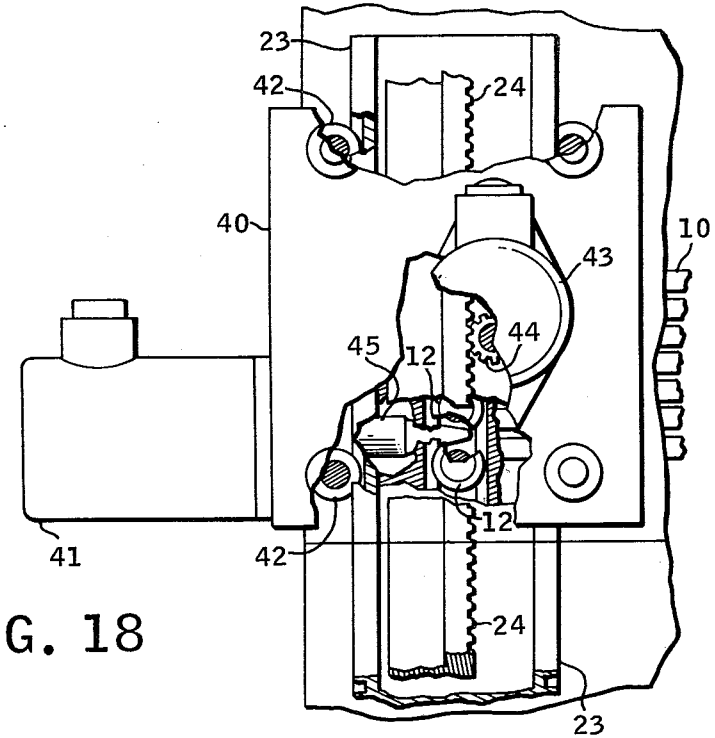
FIG. 18 is a sectional view taken substantially along a plane indicated by section line 18—18 in FIG. 17.
Figure 20:
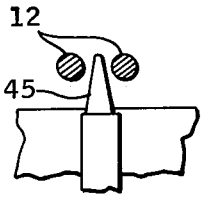
FIG. 20 is a sectional view taken substantially along a plane indicated by section line 20—20 in FIG. 19.

FIGS. 17, 18, and 19 more clearly illustrate the carriage track 23 and gear track 24 engaging deployment carriage 40. Four carriage wheels 42 are attached to the carriage 40 and are positioned so that two wheels ride in the upper channel surface and two in the lower channel surface of carriage track 23. A d.c. stepping motor 43 is mounted to the carriage 40 to drive a pinion 44 which is engaged in the gear rack 24 to propel the carriage 40 back and forth along carriage track 23. Solenoid 41 is mounted to the carriage 40 with its axis located 90° to the carriage motor 43. The solenoid plunger 45 is conically tapered and located to engage the shaft portion of lower rollers 12, best seen in FIG. 20.

The upper retraction carriage 50 is constructed and operates in the same manner as lower deployment carriage 40. The distance travelled by upper carriage 50 is considerably shorter than that of lower carriage 40 and therefore the upper carriage track and carriage gear rack are proportionally shorter than those required for the lower carriage 40.

From the preceding description it may be appreciated that this improved deployment and retraction system operates by action on the upper and lower panel hinge rollers 11 and 12, and all mechanisms and devices that contacted the panel surfaces or structure, as previously disclosed in our prior inventions, have been eliminated. For example, by using rollers 11 and 12 at the hinge lines, the panel edge engaged driving sprockets have been eliminated; the creasing arms that contacted the panels have been eliminated; and the shutter arms and bar that contacted the panels are eliminated. Thus, it is possible to mount more delicate, lighter weight materials to the isogrid structured panels without risking damage to these materials caused by scuffing contact with the actuating mechanism. The deployment and retraction sequences are accomplished primarily by the lower carriage 40 moving the lower rollers 12 along the lower straight raceway 22. The panels may also be deployed or retracted by powering the upper rollers 11 in the upper curved raceway 21, which will hereinafter be described.

Figure 22:
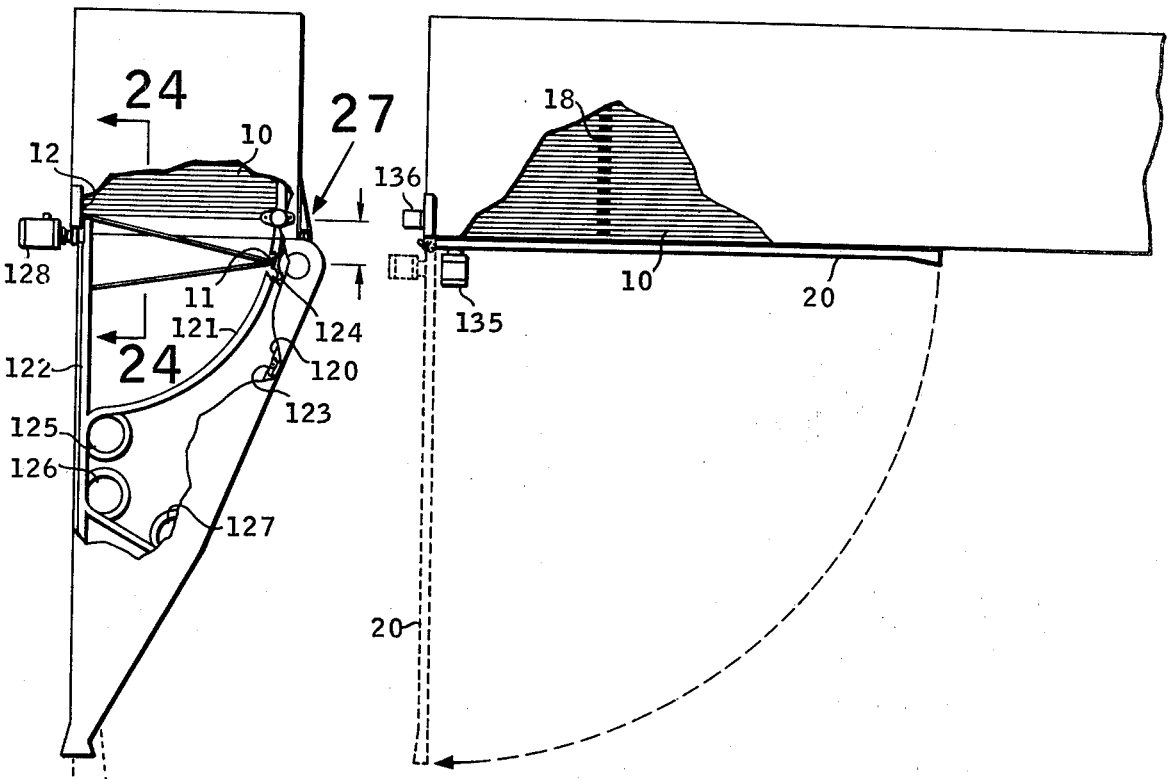
FIG. 22 is a plan view of the general arrangement of the chain drive system.
Figure 23:
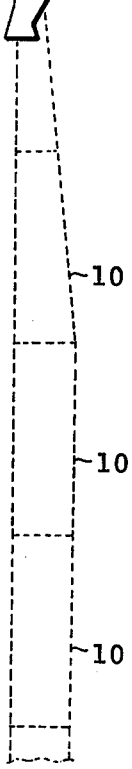
FIG. 23 is a side elevation view of the general arrangement of the chain drive system.
Figure 21:
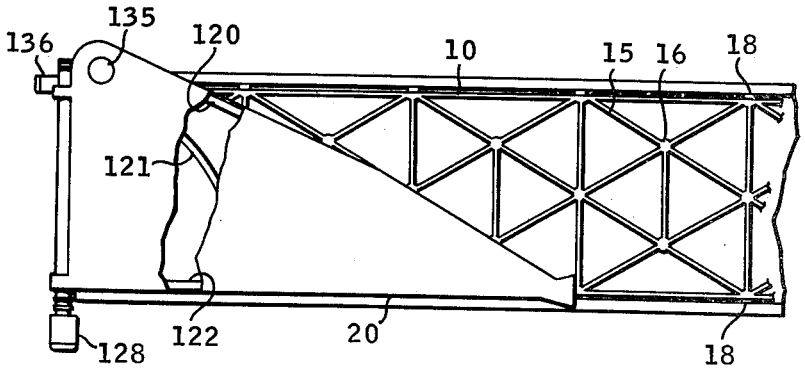
FIG. 21 is a front elevation view of the general arrangement of the chain drive system.

FIGS. 21, 22 and 23 illustrate the general arrangement for actuating the isogrid panels by means of powered movement of the upper rollers 11 in the curved raceway. The deployment frames 120 contain a curved raceway 121 for guiding the upper rollers 11 and a lower straight raceway 122 for guiding lower rollers 12. Located within the curved raceway 121 is a continuous chain 123 which engages a powered sprocket 124 located at the top entry to the curved raceway 121, continues around idler sprocket 125 located at the raceway transition point, around idler sprocket 126 at the raceway exit, and around idler sprocket 127 before returning to powered sprocket 124.

Instead of a linear actuator for rotating the deployment frames 120, such as previously shown in FIGS. 12 and 13, it will be observed in FIG. 23 that a rotary actuator 128 is used for this purpose.

Figure 24:
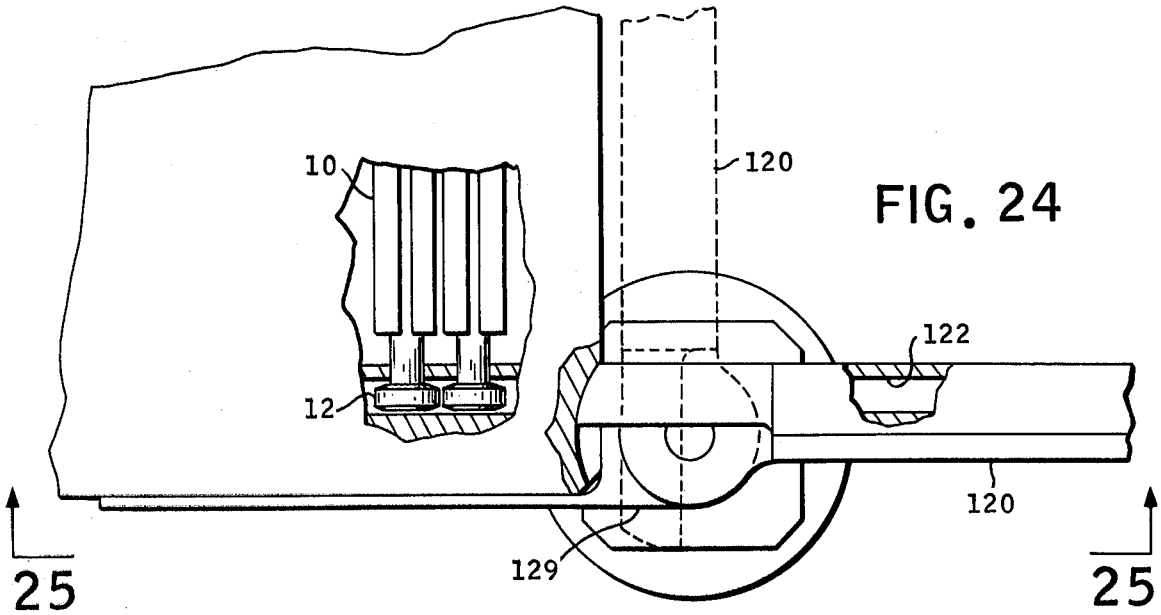
FIG. 24 is a partial plan view of the frame lower hinge and actuator taken from a plane indicated by line 24—24 in FIG. 23.
Figure 25:
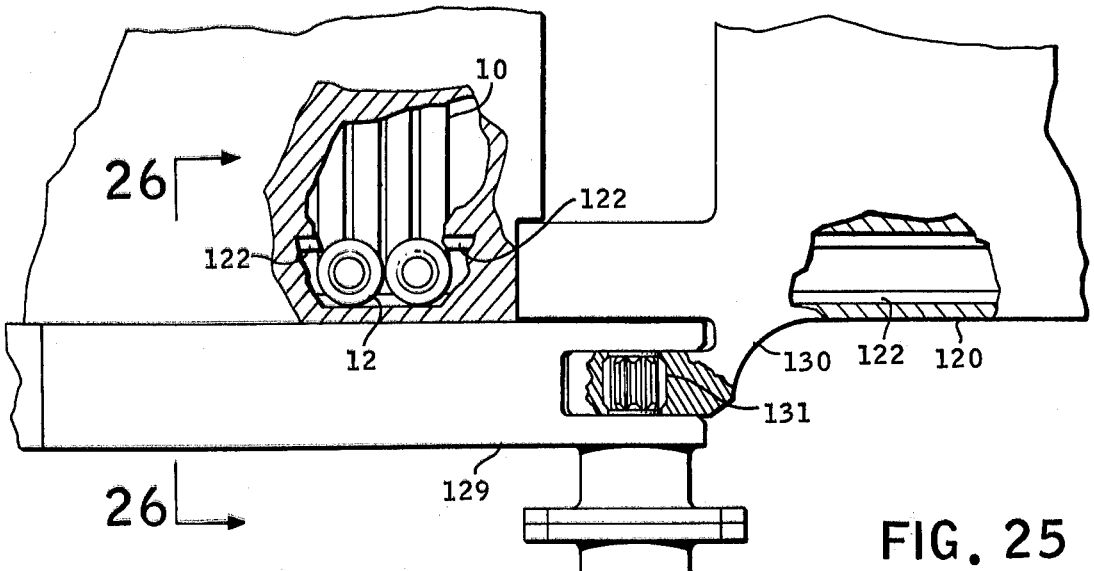
FIG. 25 is a side elevation view of the frame lower hinge and actuator taken from a plane indicated by line 25—25 in FIG. 24.
Figure 26:
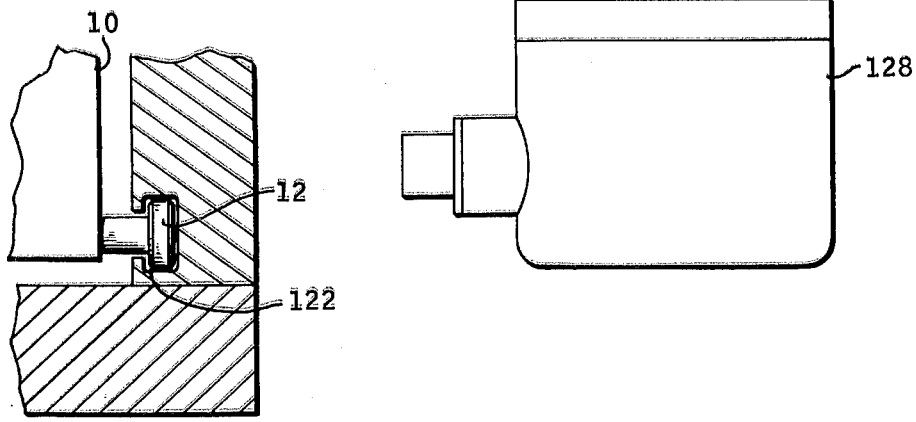
FIG. 26 is a cross-section view of the lower raceway taken substantially along a plane indicated by line 26—26 in FIG. 25.

FIGS. 24 and 25 more clearly illustrate the arrangement of the deployment frame actuator 128. A clevis hinge fitting 129 is attached to the stowage container and provides a flange for the attachment of the rotary actuator 128 thereto. The deployment frame 120 is provided with a tongue 131 that fits within the clevis portion of hinge fitting 129. The shaft of the actuator 128 is provided with a splined portion 131 that engages a mating spline in tongue 130. Thus with the housing of actuator 128 attached to the flange of hinge fitting 129 and the splined shaft of the actuator 128 engaged with the tongue 130 of frame 120, it may be seen that rotation of the actuator shaft will rotate frame 120 about the hinge fitting 129, and when rotated to the fully deployed position the lower straight raceway 122 portion located in the stowage container and that portion contained in deployment frame 120 are in alignment. FIG. 26 illustrates the cross-sectional view of the lower raceway 122 when so aligned.

FIGS. 27, 28, and 29 illustrate the arrangement of the chain 123 which is comprised of a plurality of links 132 connected together by pins 133. Rotatably mounted to each pin 133 and sandwiched between pairs of links are chain rollers 134. These chain rollers are engaged by a powered sprocket 124 which is driven by rotary actuator 135. This rotary actuator 135 as well as the deployment frame actuator 128 may be pneumatically, hydraulically, or electrically driven, however in the preferred embodiment all controls are electrically powered and the preferred actuators for these purposes are d.c. stepping motors.

The chain rollers are sized to fit within the upper raceway 121 and to capture an upper panel roller 11 which is thereafter transported down the curved portion of the raceway and thru the transition from a curved raceway to a straight raceway at idler sprocket 125 (see FIG. 23).

The chain rollers 134 and the captured panel roller 11 travel in a straight path between idler sprockets 125 and 126, and during this travel the lower panel roller 12 at the other end of the panel is drawn from the panel stack to start its travel along the lower raceway 122 and causes the next stowed pair of panels to start to unfold, assuming a position best seen in FIG. 3. It will be observed that the short travel of lower panel roller 12 from the stack has partially unfolded the next pair of panels and caused the upper roller 11 located at the apex of the partially unfolded panels to move out of the stack sufficiently to be engaged by the chain 123 as it comes around power sprocket 124. For a brief period of travel the upper roller 11 of one pair of panels is travelling in a linear direction as it passes the exit idler 126 while simultaneously the upper roller 11 of the next pair of panels is travelling in a curved direction at powered sprocket 124. This condition establishes two parameters of the arrangement of chain 123.

The chain links 132 must be of a sufficient length to space the chain rollers 134 apart from one another a distance to permit a required amount of play of the upper panel roller 11 between a pair of chain rollers 134. This is required because the travel of the two panel rollers 11, which are simultaneously engaged by the chain for a brief period of time, do not travel precisely the same distance relative to the chain. Secondly, the total length of the chain must be composed of an integer number of link lengths (chain roller spacings) that are compatable with the panel geometry and raceway path to cause proper engagement of panel rollers at the entrance in the vicinity of power sprocket 124 and the exit in the vicinity of sprocket 126. Thus, when the chain is properly sized the panel rollers 11 are powered by the chain when travelling between transition idler sprocket 125 and exit idler sprocket 126 and thereafter the power is delivered to the next roller 11 as it passes powered sprocket 124. The reverse of this sequence is used during panel retraction.

To assist in the proper sequencing of upper panel rollers 11, a holding solenoid 136 is positioned at the upper front edge of the panel stowage container to engage upper rollers 11. Actuation of this solenoid retracts the plunger sufficiently to release one roller 11 at a time. This escapement function may also be provided if desired by a clip spring 35, best shown in FIG. 14.

From the foregoing description it may be understood that deployment or retraction of the plurality of isogrid panels is accomplished by powered movement of the lower panel rollers 12 in the lower raceway by the system shown in FIGS. 11 thru 20, and by powered movement of the upper panel rollers 11 in the upper curved raceway by the system shown in FIGS. 21 thru 29. It should also be understood that either of these systems may be adapted to solely perform the panel deployment and retraction functions or be combined in one system, and that the deployment frames may be rotated by either the linear actuator 60 (FIG. 13) or the rotary actuator 128 (FIG. 23). Other elements of one system may be utilized in the other system, as for example the upper carriage 50 of the first described system may be utilized to assist in transporting upper rollers 11 in raceway 121 to the power sprocket 124 portion of chain 123. The upper carriage would further be utilized to return upper rollers to the stowage container during the retraction mode. It should further be understood that these deployment and retraction systems may be adapted for only partial movement of the panel array to decrease or increase the deployed length and that total retraction of all panels into the stowage compartment may not be a requirement of the system.

As previously described herein the actuators utilized in the system may be stepping motors where the characteristics of a stepping motor are desired. Stepping motors may be utilized to perform as electrical ratchets, so that within the holding torque capability of the motor a mechanism will not move except on signal from the programmer. This type motor produces precise intermittent angular motion from low level electrical signals, and commands for the motor motion are easily stored, as for example on magnetic tape. Switching signals may also be generated by a shaft operated switch, oscillator, photo cell circuit or other means that furnish on-off command signals, each signal advancing the motor one step.

This electrical ratchet function permits the elimination of slip clutches on the drive motors for preloading the mechanism. Also because of the ability to precisely position these stepping motors and for the programmer to know precisely where the motor shaft has been positioned, it is unnecessary to utilize shaft encoders to obtain position input to the logic system in order to properly sequence the operations.

As previously described, the individual panels 10 are of an open isogrid construction. The characteristics of isogrid structures for broad scale strain redistribution are used to insure no excessive local straining of whatever surface is mounted to the isogrid panels. Open isogrid structured panels allow larger back radiation from the surface mounted thereon than most other panel constructions, and the open structure permits access to the back side of the mounted surface for attaching components or for repair.

Low compliances with respect to forces in the plane of the panels are desirable to obtain maximum deployed structural rigidity, however compliances must be adequate to insure that creasing forces to overcome hinge restraints do not yield the isogrid structure or excessively strain the solar cell substrate, reflective material, or other surface that may be carried by the isogrid structure.

The isogrid node-to-node spacing, grid cross-sections, and node diameters are all variables that may be altered to obtain the desired performance for a particular sized panel structure and deployment mechanism. The actuators described herein may be powered by other sources, and various cross-section shaped raceways may be fitted to other type raceway followers which may be substituted for the panel hinge rollers. Other arrangements, modifications, and applications of the invention will also become apparent to those skilled in the art upon reading the present disclosure, and these would be included within the scope and spirit of the invention.

We claim:

1. An improved panel deployment and retraction system of the type wherein a plurality of panels are hinged together in an end-to-end relation and alternately folded into an accordian folded stack, said panels adapted for unfolding between two deployment frames and subsequently being extended beyond said frames to form an elongated array of a type which may later be sequentially creased and folded, one pair of panels at a time, to reform an accordian folded stack, wherein the improvement comprises:

- a plurality of rollers, one roller rotatably mounted to each end of each panel hinge, said rollers disposed in an upper row and a lower row when said panels are in an accordian folded stack;
- a curved raceway formed in each deployment frame and adapted to guide rollers disposed in said upper row;
- a straight raceway formed in each deployment frame and adapted to guide rollers disposed in said lower row;
- an escapement means for removing one of said rollers at a time in each of said raceways from the said folded stack; and
- a first carriage mounted on each of said deployment frames and adapted for reciprocating travel thereon for transporting each of said rollers disposed in said lower row along said straight raceway.

2. The deployment and retraction system of claim 1 further comprising:

- a gear rack located on each of said deployment frames and disposed substantially parallel to said straight raceway;
- a carriage track located on each of said deployment frames and disposed substantially parallel to said gear rack;
- a plurality of wheels mounted to said first carriage and adapted for rolling on said carriage track; and
- a pinion rotatably mounted to said first carriage and engaged in said gear rack for moving said first carriage along said gear rack.

3. The deployment and retraction system of claim 2 further comprising a second carriage mounted on each of said deployment frames and adapted for reciprocating travel thereon for transporting each of said rollers disposed in said upper row along a portion of said curved raceway.

4. The deployment and retraction system of claim 3 wherein said escapement means comprises a plurality of clip springs, one clip spring mounted adjacent to each of said raceways.

5. The deployment and retraction system of claim 3 wherein said escapement means comprises a plurality of solenoids, one solenoid mounted adjacent to each of said raceways.

6. The deployment and retraction system of claim 3 further comprising:

a continuous chain shaped for engaging rollers disposed in said upper row and transporting said rollers along said curved raceway;

a powered sprocket located adjacent to the entrance of said curved raceway and adapted to engage said continuous chain; and an idler sprocket located adjacent to the exit of said curved raceway and adapted to engage said continuous chain.

7. An improved panel deployment and retraction system of the type wherein a plurality of panels are hinged together in an end-to-end relation and alternately folded into an accordian folded stack, said panels adapted for unfolding between two deployment frames and subsequently being extended beyond said frames to form an elongated array of a type which may later be sequentially creased and folded, one pair of panels at a time, to reform an accordian folded stack, wherein the improvement comprises:

a plurality of rollers, one roller rotatably mounted to each end of said panel hinge, said rollers disposed in an upper row and a lower row when said panels are in an accordian folded stack;

a curved raceway formed in each deployment frame and adapted to guide rollers disposed in said upper row;

a straight raceway formed in each deployment frame and adapted to guide rollers disposed in said lower row;

an escapement means for removing one of said rollers at a time in each of said raceways from the said folded stack;

a continuous chain shaped for engaging rollers disposed in said upper row and transporting said rollers along said curved raceway;

a powered sprocket located adjacent to the entrance of said curved raceway and adapted to engage said continuous chain; and an idler sprocket located adjacent to the exit of said curved raceway and adapted to engage said continuous chain.

8. The deployment and retraction system of claim 7 further comprising a carriage mounted on each of said deployment frames and adapted for reciprocating travel thereon for transporting each of said rollers disposed in said upper row along a portion of said curved raceway situated between said panel stack and said powered sprocket.

9. The deployment and retraction system of claim 8 further comprising:

a gear rack located on each of said deployment frames and disposed substantially parallel to a portion of said curved raceway;

a carriage track located on each of said deployment frames and disposed substantially parallel to said gear rack;

a plurality of wheels mounted to said carriage and adapted for rolling on said carriage track; and a pinion rotatably mounted to said carriage and engaged in said gear rack for moving said carriage along said gear rack.

* * * * *